US005246075A

United States Patent [19]

Caulfield

[11] Patent Number: 5,246,075

[45] Date of Patent: Sep. 21, 1993

[54] GUIDE POST LATCHING MECHANISM

[75] Inventor: John K. Caulfield, Houston, Tex.

[73] Assignee: National-Oilwell, Houston, Tex.

[21] Appl. No.: 817,230

[22] Filed: Jan. 6, 1992

[51] Int. Cl.[5] ..... E21B 7/128

[52] U.S. Cl. ..... 166/339; 166/342; 166/349; 405/195.1

[58] Field of Search ..... 166/342, 349, 339; 405/195, 224, 169

[56] References Cited

U.S. PATENT DOCUMENTS

| | | | |
|---|---|---|---|
| 4,391,331 | 7/1983 | Shotbolt | 166/342 |
| 4,405,263 | 9/1983 | Hall | 405/224 |
| 4,523,878 | 6/1985 | Richart et al. | 405/195 |
| 4,611,661 | 9/1986 | Hed et al. | 166/339 |
| 4,828,035 | 5/1989 | McInturff | 165/339 |
| 4,867,605 | 9/1989 | Myers et al. | 405/169 |
| 4,881,850 | 11/1989 | Abreo, Jr. | 405/169 |
| 4,927,295 | 5/1990 | Knowles | 405/195 |
| 5,002,129 | 3/1991 | Hopper | 166/338 |
| 5,007,769 | 4/1991 | Legris et al. | 405/195 |

*Primary Examiner*—Hoang C. Dang

*Attorney, Agent, or Firm*—R. J. Bunyard; L. A. Fillnow; R. H. Johnson

[57] ABSTRACT

Apparatus having removable posts for guiding subsea well equipment. The apparatus includes a frame for permanent attachment to a well installation. The frame includes outwardly extending legs with each of the legs for receiving an upstanding retrievable guide post. Each leg includes a latching mechanism and a guide foot for receiving an upstanding guide post. The latching mechanism includes a retainer rotatable between a latching position, a latched position and an unlatched position. The latching mechanism preferably includes a handle connected to the retainer with the retainer being rotatably connected to the top of the frame. The retainer may include a beam for engaging a shoulder on the guide post when in the latched position. The handle is in a downward position when the retainer is in the unlatched position prior to the guide post being seated in the guide foot.

13 Claims, 11 Drawing Sheets

GUIDE POST LATCHING MECHANISM

BACKGROUND OF THE INVENTION

The invention relates to removable guide posts for the guide base of a subsea oil or gas installation.

During drilling, a guide base normally is positioned around the conductor housing of a well. The guide base includes upstanding guide posts at the corners of the guide base frame. The lower ends of wire lines or cables are anchored to the guide posts and the upper ends of the wire lines are supported from a floating drilling vessel. After the conductor housing and guide base are installed, a well head, blow out preventers, a Christmas tree and other equipment are guided into position by the wire lines and the guide posts.

Subsea guide bases are usually permanently installed and cannot be removed or repair. If a guide post becomes bent or damaged during use, the drilling operation would be disrupted if it was necessary to retrieve the guide base. In such cases, it is a definite functional advantage to retrieve the damaged post independently. At other times it may be desirable to transfer undamaged guide posts from one well head area of a seabed to another well head area.

Techniques recently have been developed to replace guide posts without removing the guide base from the seabed. These techniques generally require the use of a diver or a removely operated vehicle (ROV). Unfortunately, the equipment designed for subsea removal or guide posts generally includes a complex mechanism having a hydraulically operated split ring or a locking pin. These mechanisms generally do not provide definite visual feedback to the diver or ROV in all the functional modes of operation to determine if the mechanism is or will function properly once the diver or ROV has left the guide base. Another disadvantage of these mechanisms is that they generally require diver or ROV assistance throughout the entire guide post removal sequence, thus necessitating intricate work requirements by the diver or ROV. A ROV in such a situation will, in many cases, have to "dock" or attach itself in a stable manner to the structure in order to have a reasonable change to perform the intricate manipulating tasks required to operate the mechanism.

Modern ROV's have the potential to do many different types of motion or manipulation, i.e., rotation, grasping, lifting and the like, but generally have the ability to exert only minimal amount of force in doing so. This fact has caused a problem to which existing post mechanisms do not adequately address. A mechanism to hold a guide post in place under loads in the thousands of pounds must be "unlatched" or "overridden" by ROV forces generally measured in the tens of pounds.

Accordingly, there remains a need for a simple mechanism allowing replacement of guide posts without removing the guide base from the seabed. The mechanism should require minimal use of a diver or an ROV, should provide visual feedback to the operator, should require minimal force to operate and should require no or minimal operator assistance during the guide post removal sequence.

BRIEF SUMMARY OF THE INVENTION

The invention relates to apparatus having a removable post for guiding subsea well equipment and a method therefore. The apparatus includes a frame for permanent attachment to a well installation. The frame includes a guide foot for receiving an upstanding guide post and a latching mechanism. The latching mechanism includes means for retaining the guide post with the retaining means being rotatable between a latching position, a latched position and an unlatched position for removal of the guide post.

Preferably, the latching mechanism includes a handle connected to the retaining means. The retaining means may be connected to the top of the frame and include a beam for engaging the guide post. The handle is in a downward position when the retaining means is in the unlatched position.

A principal object of the invention is to provide for a simple latching mechanism allowing replacement of guide posts without removing the guide base from the seabed.

Another object is to provide a latching mechanism requiring minimal use of a diver or an ROV during a guide post removal sequence.

Another object is to provide a latching mechanism requiring minimal force to operate within the general capabilities of divers or ROV's.

Another object is to minimize or eliminate the need for docking onto the subsea structure by simplifying the type motions or functions required of an ROV.

A further object includes providing a latching mechanism that gives visual feedback to the operator.

A feature of the invention includes an apparatus having a frame for permanent attachment to a well installation, the frame including at least one guide foot for receiving an upstanding guide post and a latching mechanism, the latching mechanism including means for retaining the guide post, the retaining means being rotatable between a latching position, a latched position and an unlatched position for removal of the guide post.

Another feature of the invention is for the aforesaid latching mechanism to include a handle.

Another feature of the invention is for the aforesaid handle being connected to the retaining means and in a downward position when the retaining means is in the unlatched position.

Another feature of the invention is for the aforesaid handle being rotatable to a position above the horizontal during installation of the guide post wherein gravitational force acting on the handle causes the retaining means to latch the guide post.

Another feature of the invention is for the aforesaid retaining means being rotatable connected to the top of the frame.

Another feature of the invention is for the aforesaid retaining means to include a beam and a cylindrical portion having a threaded bore, the cylindrical portion being rotatably connected to the top of the frame.

Another feature of the invention is for the aforesaid beam to include a chamfered end for engaging a shoulder on the guide post.

Another feature of the invention includes a method for retrieving a guide post from a subsea installation including providing a frame for attachment to a well installation, the frame including a guide post mounted in a guide foot and means for retaining the guide post, the retaining means being in a latched position engaging the guide post, rotating the retaining means in a first direction until disengaging the guide post, the removing the guide post from the guide foot whereby the retaining means is rotated in a second direction opposite to the first direction to an unlatched position.

Another feature is for the aforesaid the invention to include the additional step of positioning another guide post in the guide foot with the guide post simultaneously engaging the retaining means whereby the retaining means is rotated in the first direction until the guide post is latched within the guide foot by the retaining means.

Another feature is for the aforesaid invention to include a handle connected to the retaining means, the handle being rotated to a position above the horizontal during the rotation in the first direction whereby the retaining means is rotated during the rotation in the opposite direction by gravitational force acting on the handle.

Advantages of the invention include a guide post latching mechanism that allows subsea retrieval and subsequent reinstallation of a guide post or its replacement using a diver or an ROV, stays in any of its intermediate functional positions due to gravity without the need for application of external force, is operable by the application of minimal amounts of force and provides visual feedback to a diver or a camera in a ROV. A further advantage including being able to secure a wire lien to a guide base by reorientation of the guide post.

The above and other objects, features and advantages of the invention will become apparent upon consideration of the detailed description and appended drawings.

BRIEF DESCRIPTION OF THE DRAWINGS

FIG. 5 is a plan view, partly in section, illustrating the latching mechanism mounted onto the frame of a guide base.

DETAILED DESCRIPTION OF THE PREFERRED EMBODIMENT

Figure 1:
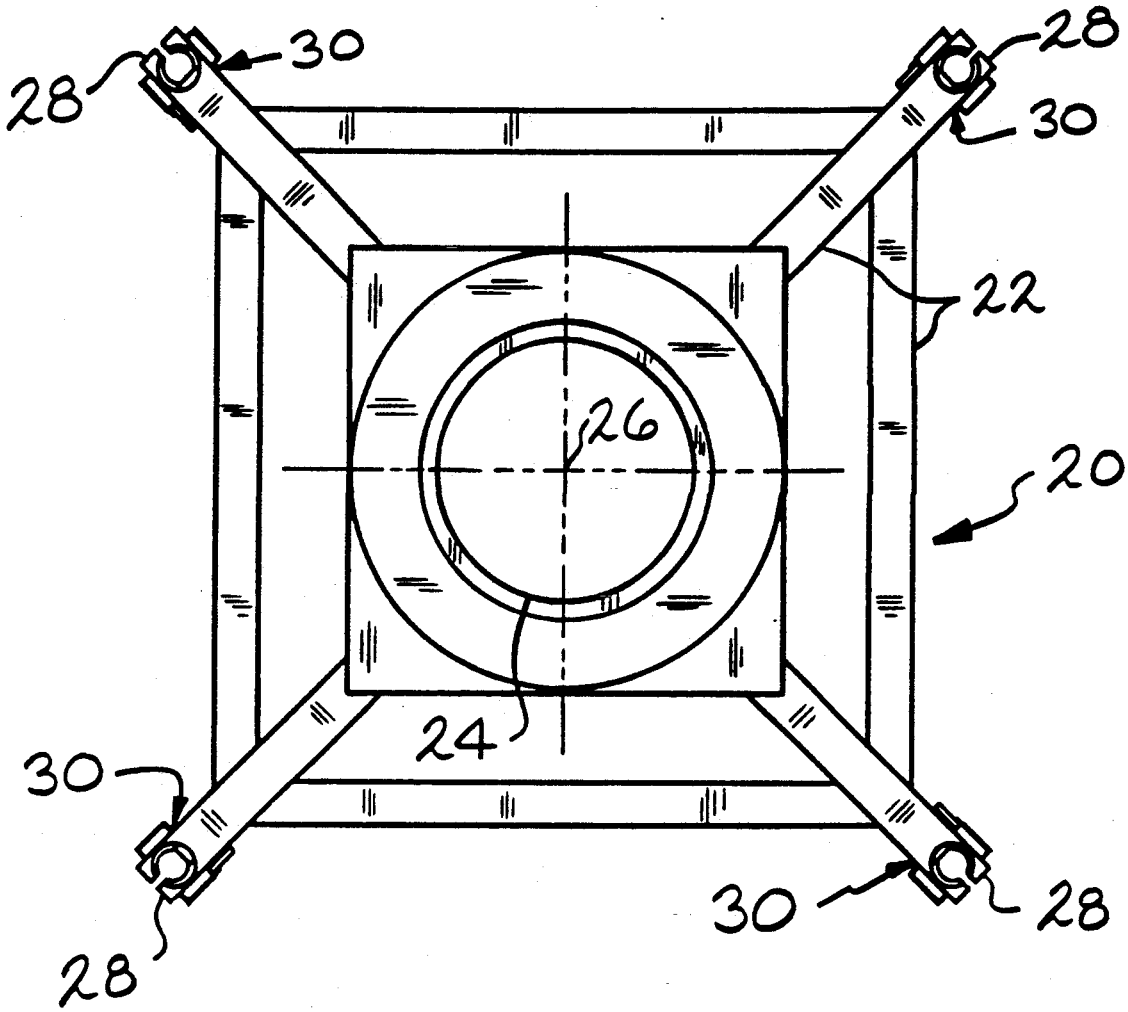
FIG. 1 is a plan view of a subsea guide base of one embodiment incorporating the invention.
Figure 2:
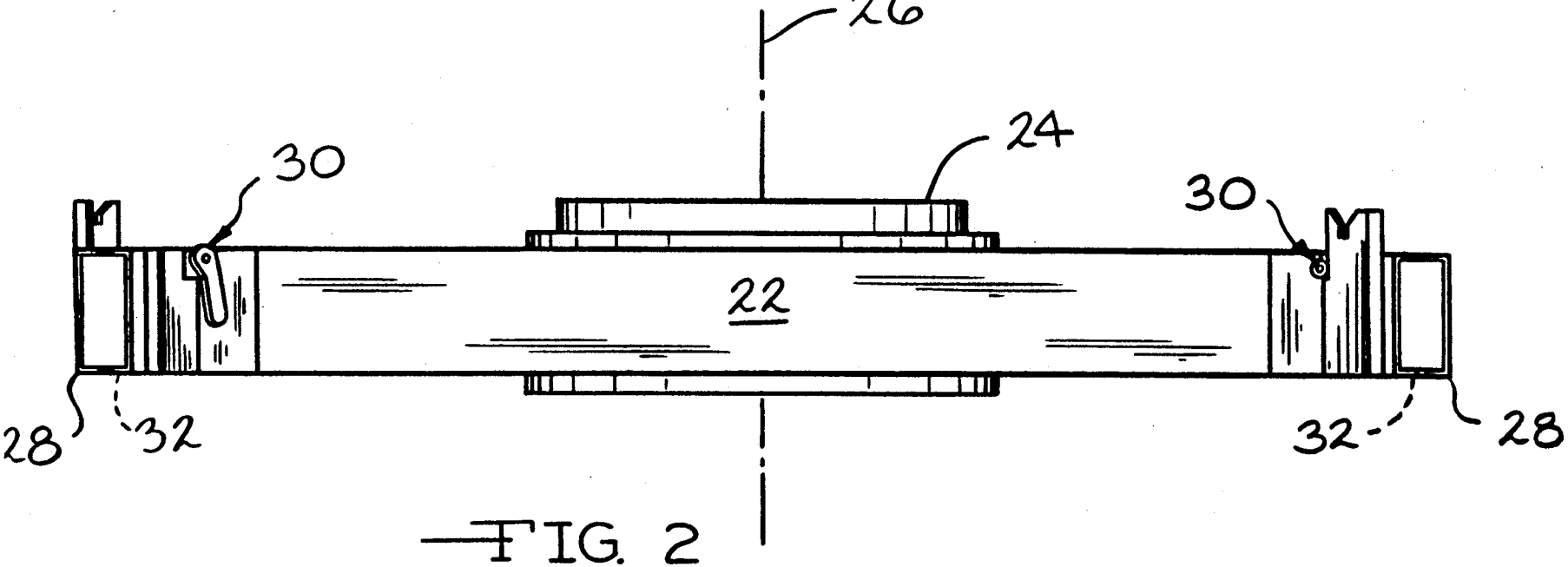
FIG. 2 is an elevation view of the apparatus of FIG. 1.

Referring to FIGS. 1 and 2, reference numeral 20 denotes a permanent guide base, template, module or other appropriate part of a subsea installation. Guide base 20 includes a frame 22 rigidly connected such as a by welding to a cylindrical central structure 24 for positioning the guide base over a centerline 26 of a subsea well. A guide foot 28 for receiving a retrievable guide post and a latching mechanism 30 are positioned on guide base 20. Preferably, guide base 20 includes a plurality of outwardly extending legs with the guide foot and latching mechanism mounted near the end of each of the legs.

Figure 3:
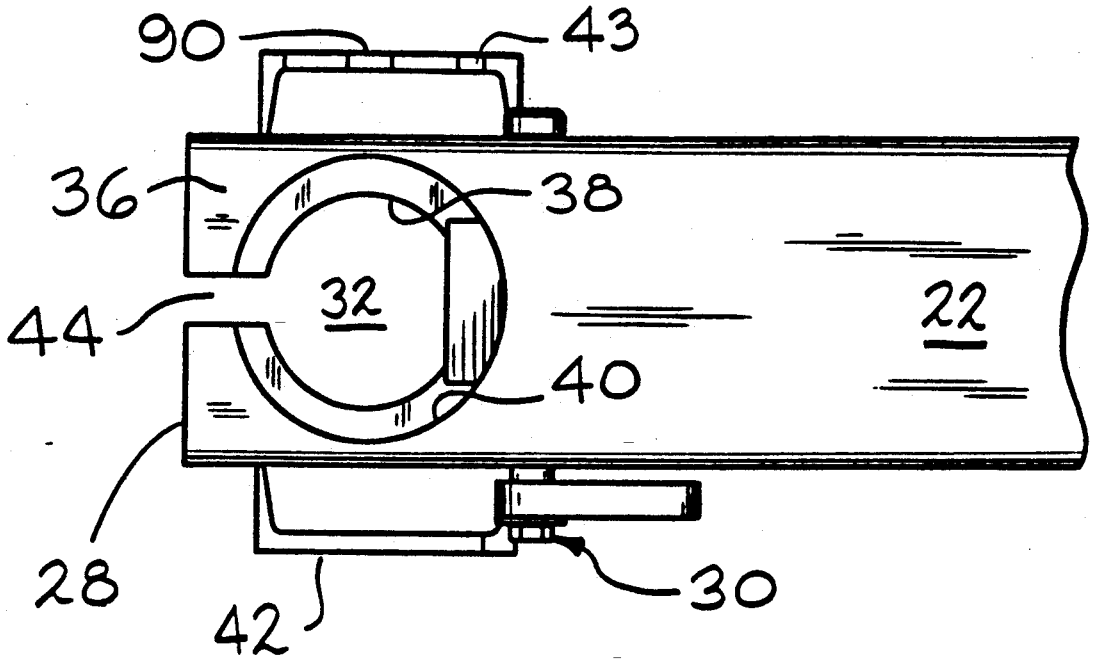
FIG. 3 is a plan view illustrating in detail one of the guide feet of the embodiment of FIG. 1.
Figure 4:
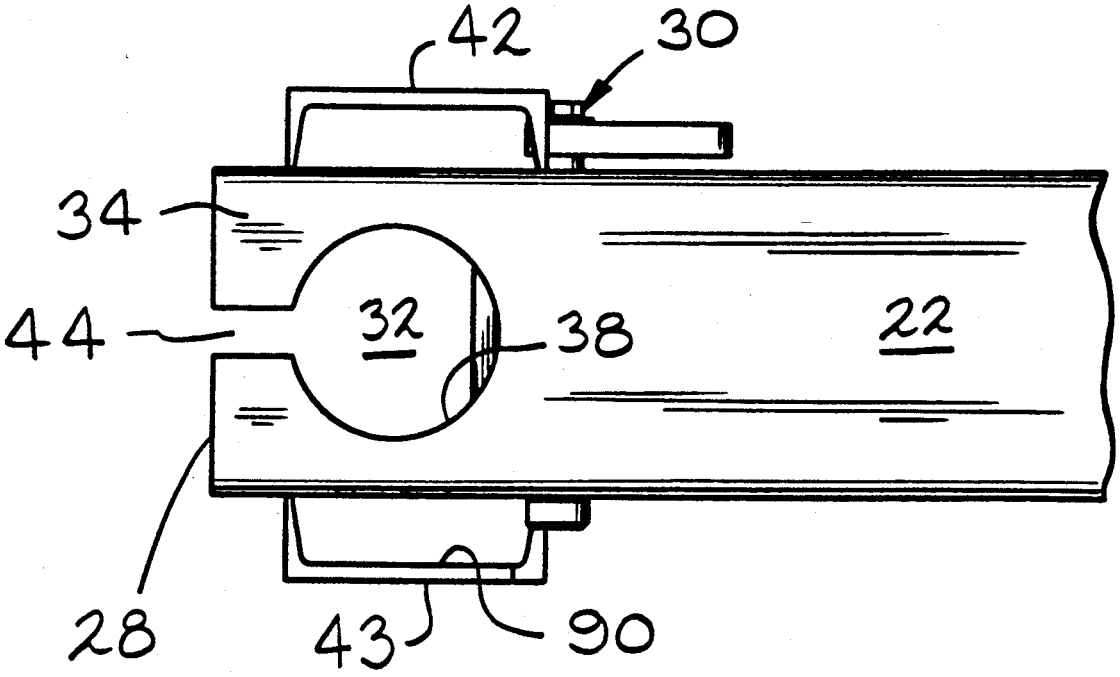
FIG. 4 is a bottom view of FIG. 3.

FIGS. 3 and 4 illustrate guide foot for 28 including a cylindrical shaped bore 32, a base plate 34 and an upper plate 36, each of which are reinforced by a pair of brackets 42 and 43. Other means such as gusset plates or structural shapes could be used to strengthen the guide foot. Base plate 35 includes an opening 38 and upper plate 36 includes an opening 40 with opening 38 having a diameter less than that of opening 40. Bore 32 is defined by opening 38 in base plate 34 and opening 40 in upper plate 36. Each of the plates may include a slot 44 extending through the outer portion thereof for receiving a wire line (not shown). Although guide foot 28 and latching mechanism 30 preferably are integral with frame 22, it will be understood each foot and latching mechanism could be a separate unit adapted to be fastened to the frame by welding or bolting.

Figure 5:
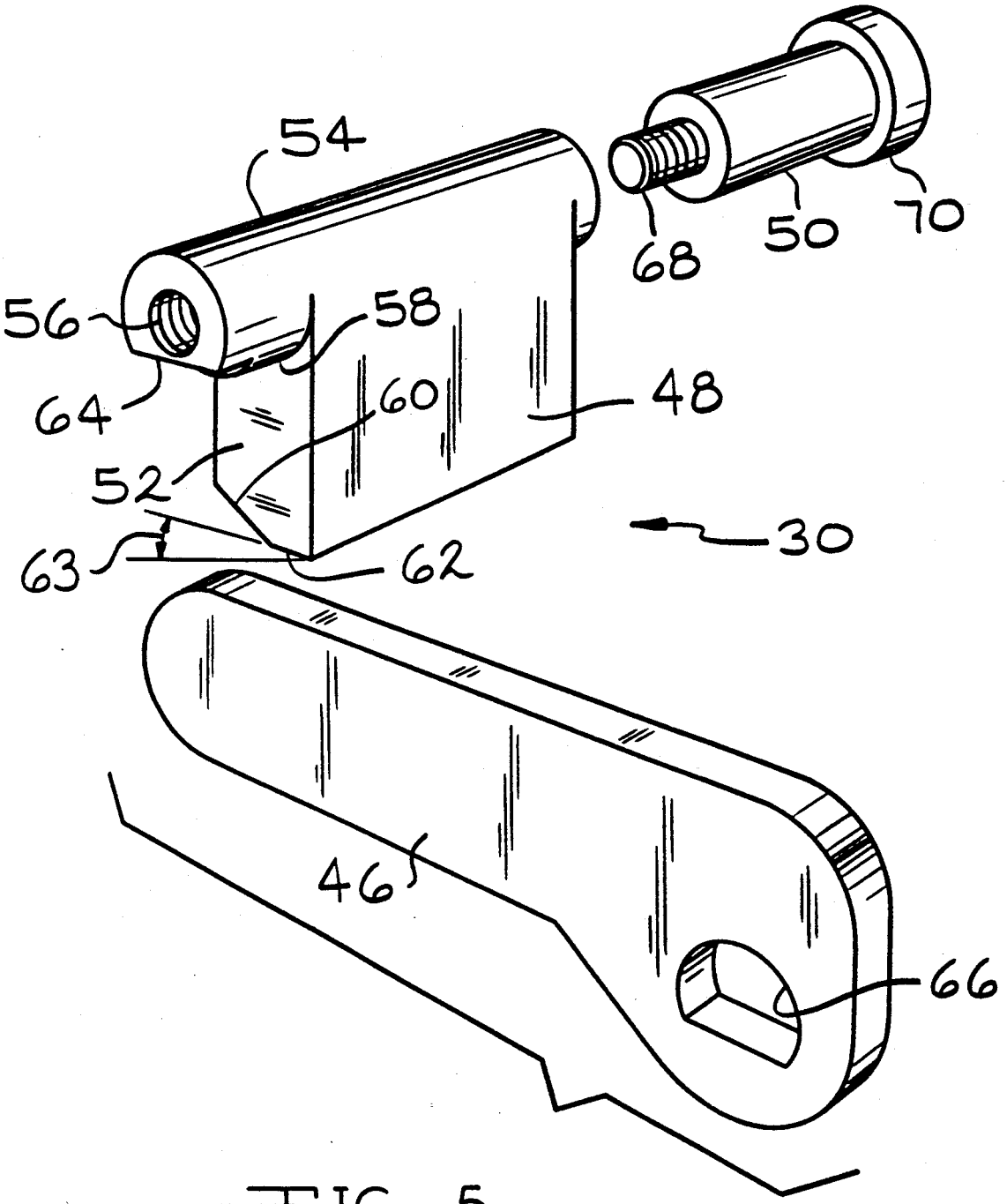
FIG. 5 is an exploded view of one embodiment of the latching mechanism of the invention.

FIG. 5 illustrates a detailed exploded view of the components of latching mechanism 30. Latching mechanism 30 includes a handle 46, a guide post retainer 48 and a machine screw 50. Retainer 48 includes a beam 52 and a cylindrical shaft 54 which are welded together with shaft 54 having a threaded bore 56. In welding together beam 52 and shaft 54, a cylindrical end 58 is left to protrude from beam 52. Beam 52 is shaped so as to include an edge 60. Edge 60 preferably is chamfered at an angle 63 on a lug 62. Angle 63 of lug 62 may be about 15°. Retainer 48 could be a one piece casting. Screw 50 includes a threaded portion 68 and a shoulder 70. End 58 of shaft 54 has a flat 64 for receiving opening 66 in handle 46. The other end of cylindrical shaft 54 receiving threaded portion 68 of screw 50.

Figure 6:
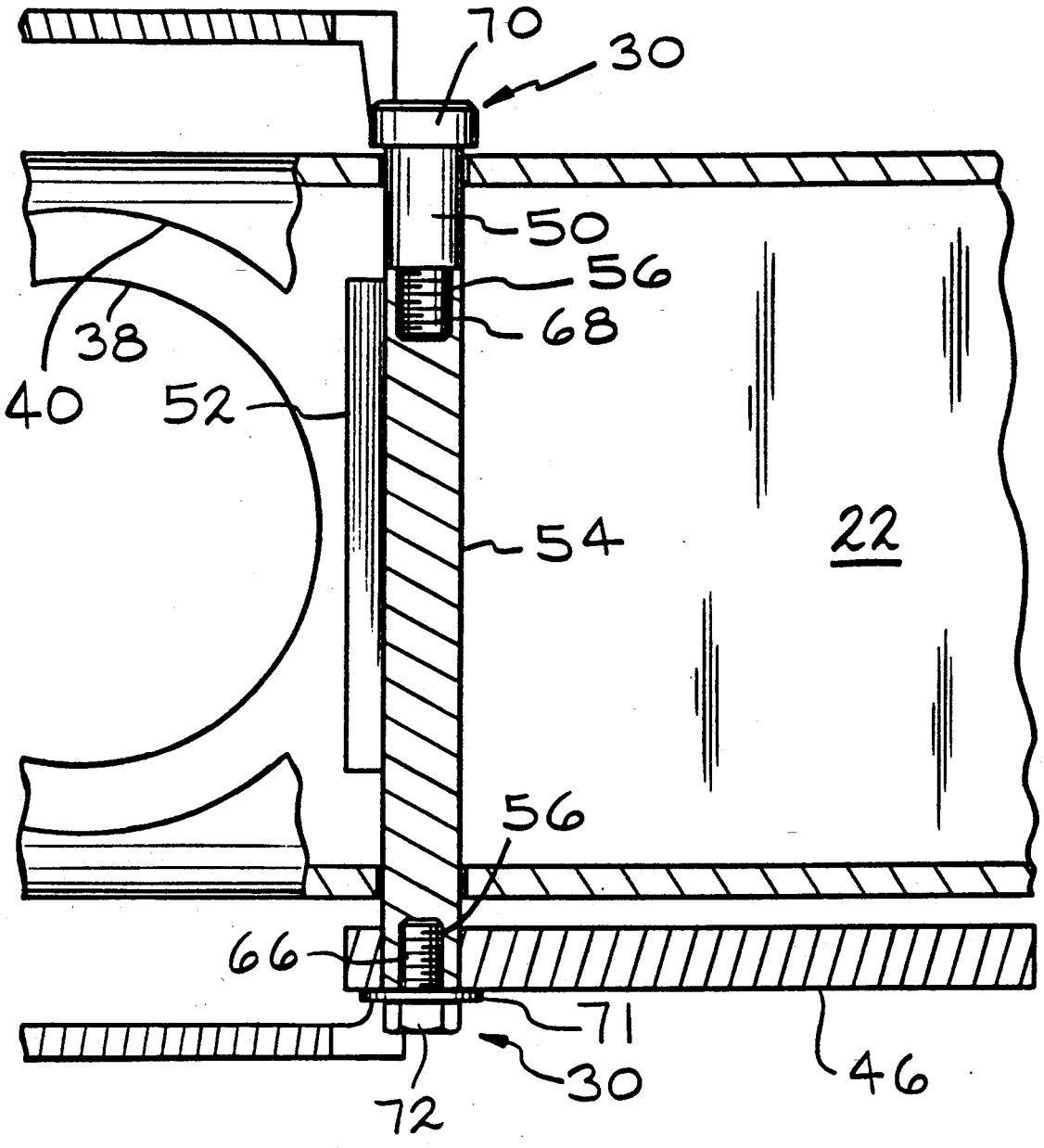

FIG. 6 illustrates latching mechanism 30 after being assembled and rotatably mounted to frame 22. Handle 46 is connected to flat 64 of cylindrical shaft 54 by a washer 71 and a bolt 72. It will be understood other means could be used for connecting the handle to retainer 48.

Figure 7:
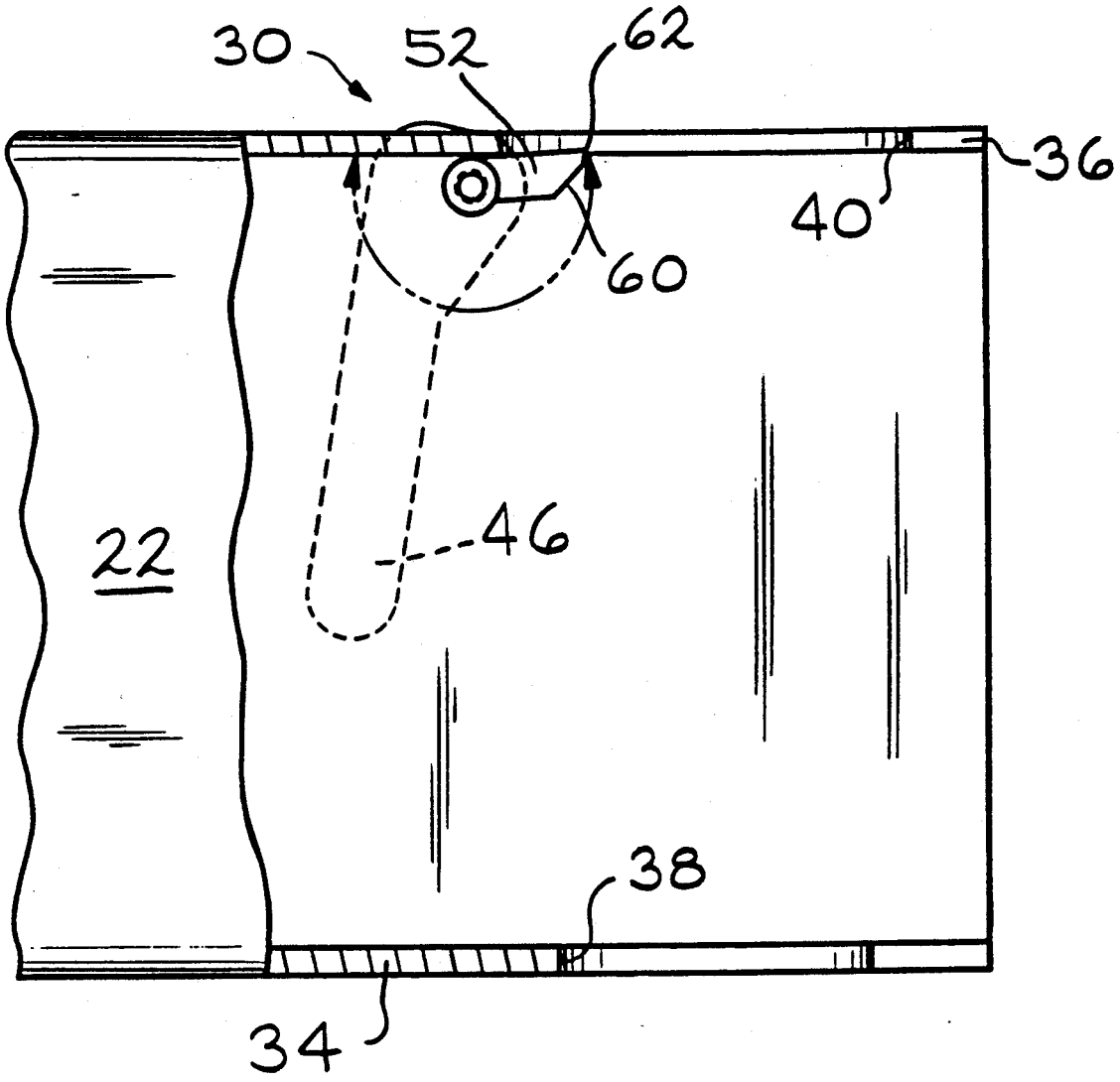
FIG. 7 is an elevation view of FIG. 6 illustrating a first or latching position for the latching mechanism.

FIG. 7 illustrates a first or latching position for latching mechanism 30 when a guide post is not seated in bore 32 of guide foot 28.

Figure 8:
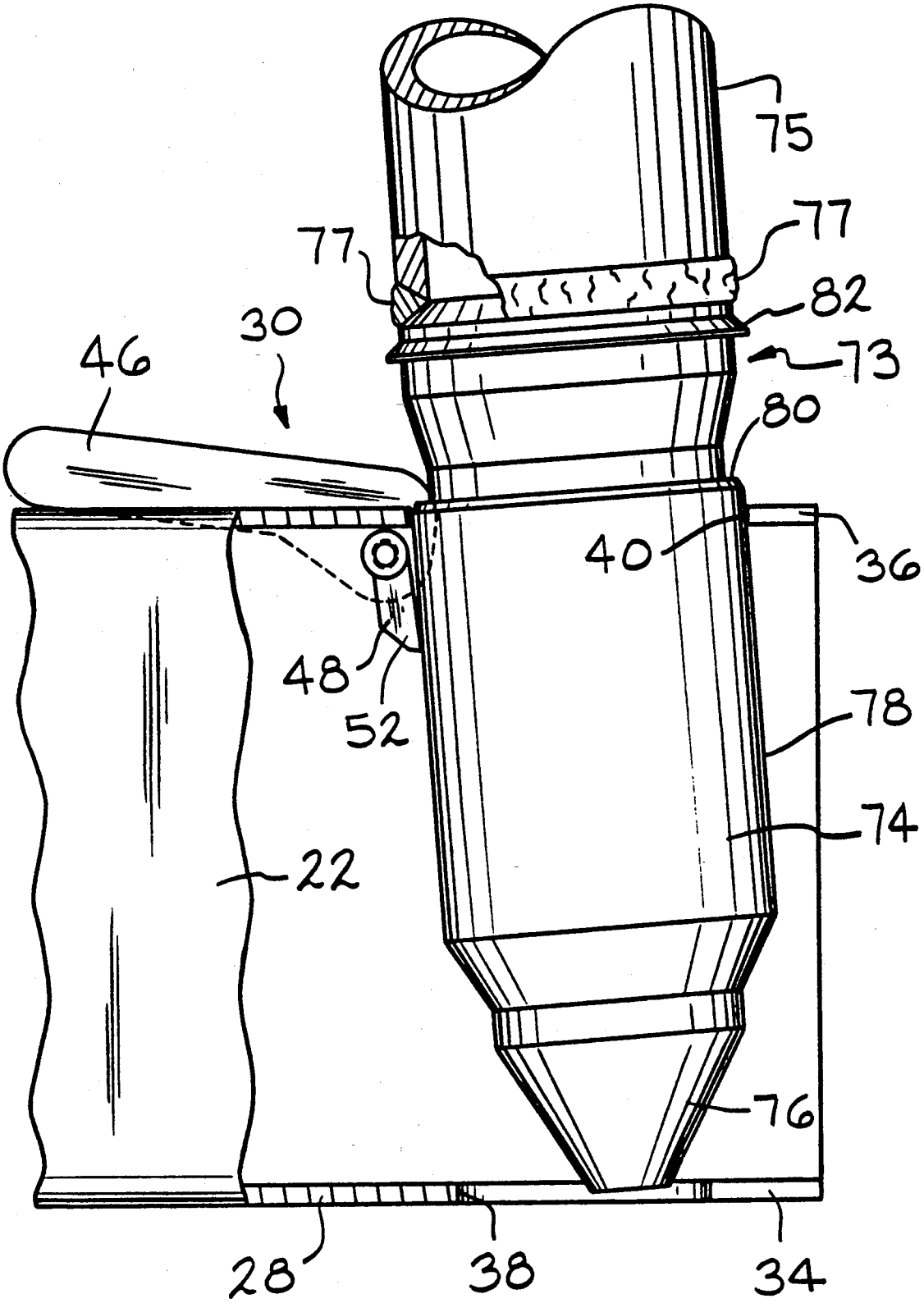
FIG. 8 is an elevation view similar to FIG. 7 illustrating a guide post being installed in one of the guide feet of the guide base.
Figure 10:
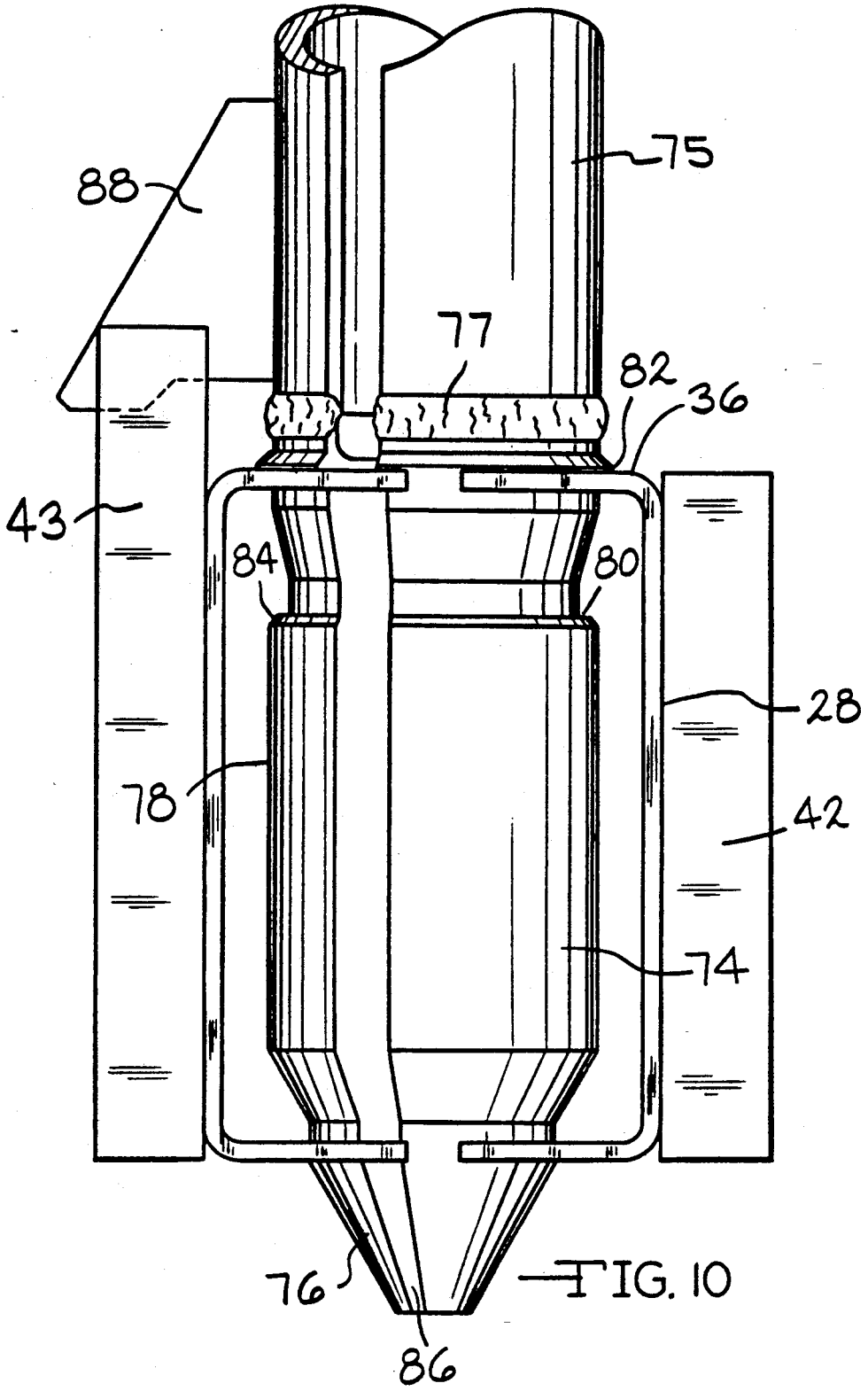
FIG. 10 is an end view of FIG. 9 illustrating the guide post slot being offset.
Figure 11:
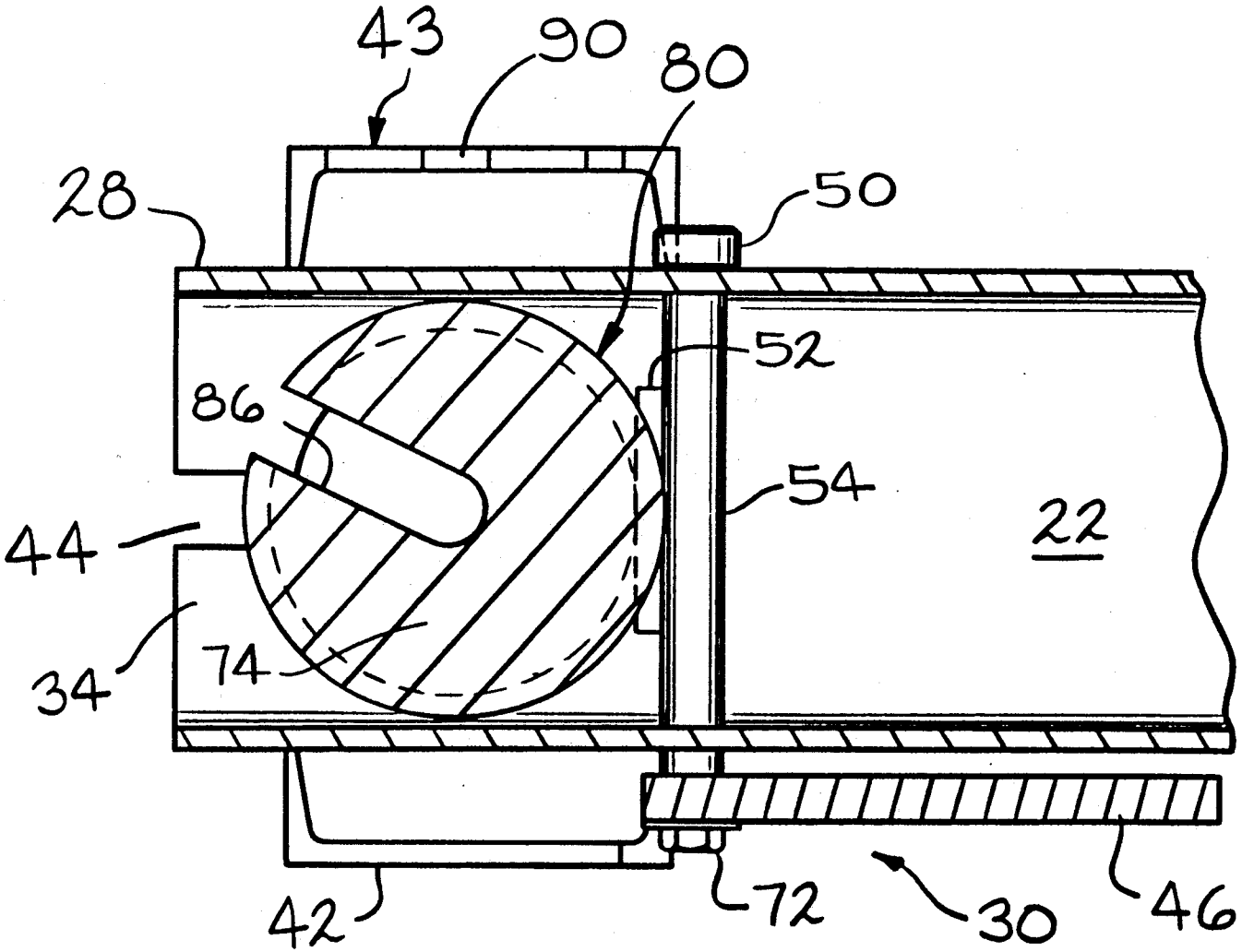
FIG. 11 is a section view along line 11—11 of FIG. 9 illustrating the guide post slot being offset about 15° for securing a wire lines.

FIG. 8 illustrates a guide post 73 having a lower portion 74 and an upper portion 75. Lower portion 74 of the guide post is received by guide foot 28 and may include a tapered nose 76, a cylindrical body 78, a lower shoulder 80, an upper shoulder 82 and a slot 86 (FIGS. 10 and 11). Lower portion 74 of the guide post is permanently attached to hollow, slotted pipe or tubular upper guide portion 75 such as by a weld 77. In FIG. 8, nose 76 has passed through opening 40 of upper plate 36 and is about to pass through opening 38 in base plate 34. The tapered configuration of nose 76 aligns guide post 73 with openings 38 and 40. The outside diameter of cylindrical body 78 is slightly less than the inside diameter of opening 40 in upper plate 36. Shortly after most 76 of lower portion 74 of guide post 73 passes through opening 40, beam 52 engages cylindrical body 78 causing retainer 48 to be rotated in a first direction, e.g., clockwise or downwardly, with handle 46 being rotated to a position slightly above the horizontal. This intermediate position is the first or latching position for latching mechanism 30.

Figure 9:
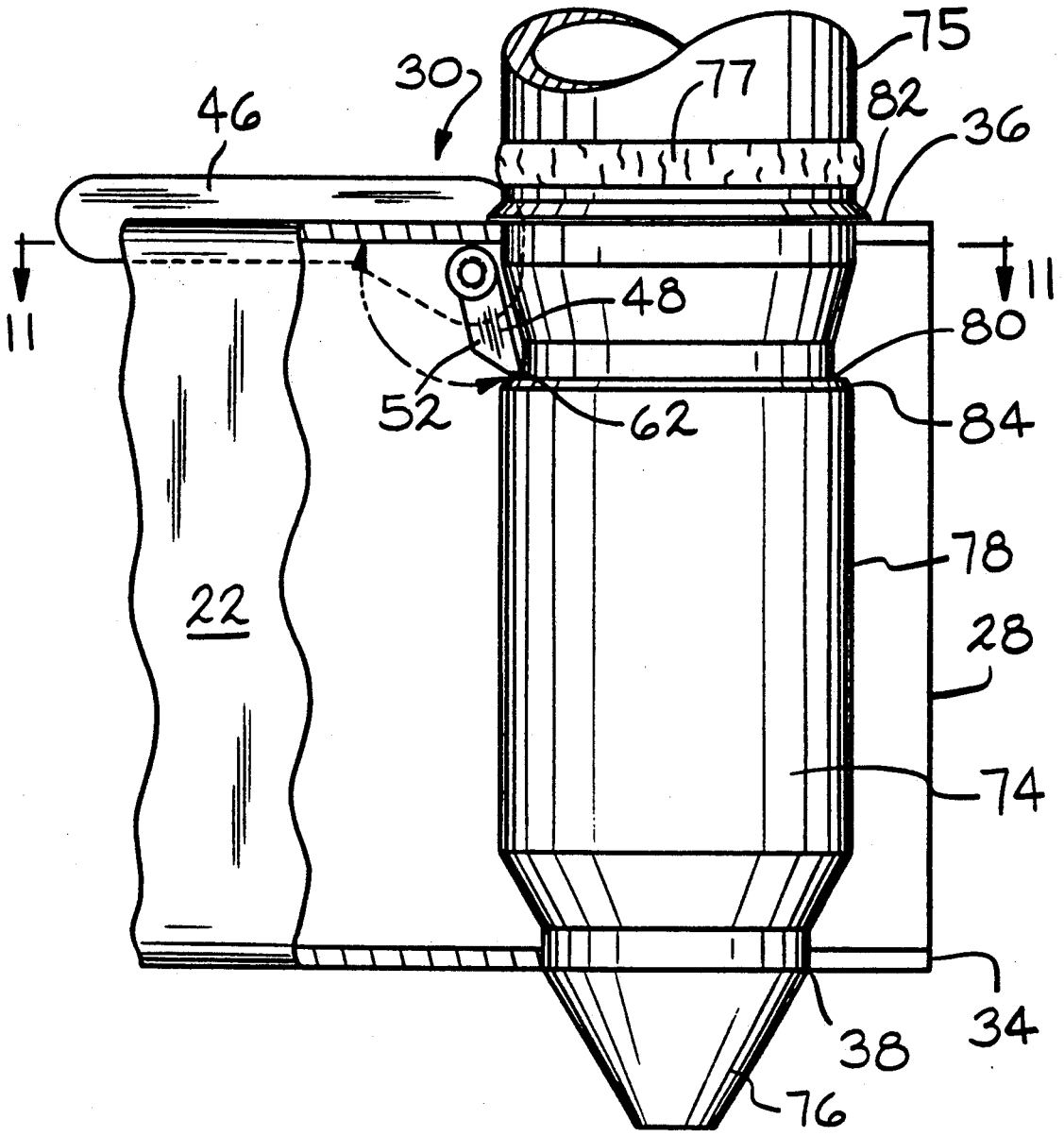
FIG. 9 is an elevation view similar to FIG. 8 with the guide post installed in the guide foot illustrating the second or latched position for the latching mechanism.

FIGS. 9 and 10 are the same as FIG. 8 except the guide post has been seated within guide foot 28 with upper shoulder 82 being seated on the upper surface of plate 36. When shoulder 82 engages plate 36, lug 62 of beam 52 passes over the upper edge 84 of body 78. Handle 46 then rotates in a second direction opposite to the first direction, e.g., counterclockwise, without any assistance from a diver or an ROV because of gravity until lug 62 of retainer 48 engages shoulder 80 of guide post portion 74. When tension is applied to the wire line, the guide post moves slightly upwardly thereby "trapping" lug 62 against shoulder 80 and the cylindrical surface 54 is trapped against the under side of upper plate 36 of frame 22. This is the second or latched position of latching mechanism 30.

FIGS. 10 and 11 illustrate an orientation plate 88 being mounted onto guide post 73 such as by welding. Plate 88 retains guide post 73 in an orientation position for entrapping the guide wire. Plate 88 fits into a mating profile 90 cut into bracket 43 so that slot 86 of guide post 73 is rotated about 15° or offset relative to slot 44 of plates 34,36. After wire lines have been installed, this slot misalignment insures that the wire line in each guide foot is trapped or secured by guide base 20. If it becomes necessary to remove the wire line from the guide base, sufficient tension is applied to guide post 73 until orientation plate 88 becomes disengaged from profile 90. Guide post 73 then is rotated by a diver or an ROV until slot 86 is aligned with slot 44. The wire line is removed.

Figure 12:
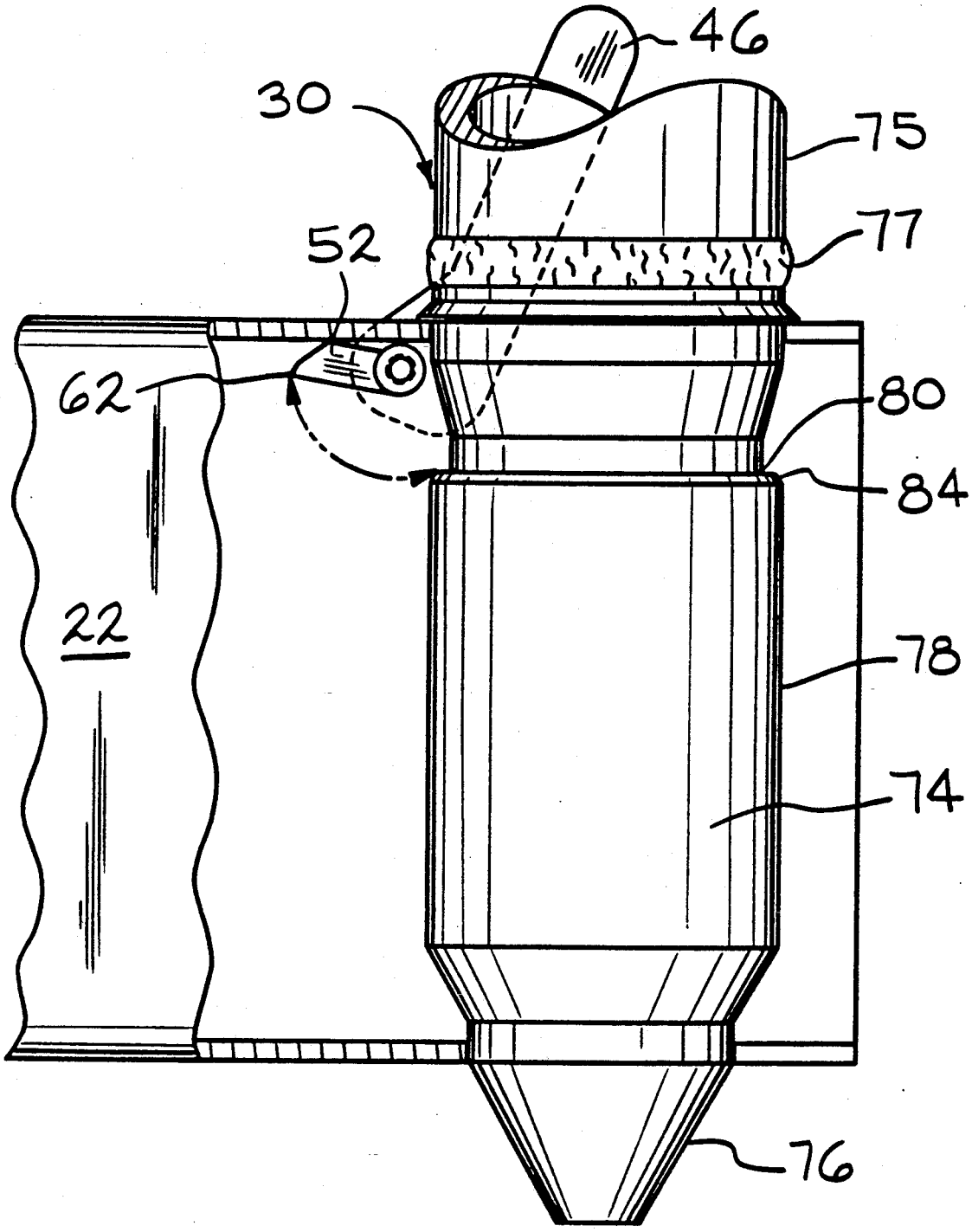
FIG. 12 is an elevation view similar to FIGS. 9 and 10 illustrating a third or unlatched position for the latching mechanism.

When it becomes desirable to retrieve a bent or damaged guide post for replacement, handle 46 is rotated to a third or unlatched position shown in FIG. 12. Handle 46 is rotated in the first direction or clockwise slightly past the vertical either using a diver or an ROV until lug 62 of beam 52 disengages shoulder 80 and clears upper edge 84 of body 78 to the position shown in FIG. 12. Handle 46 will remain in this position because of gravity. Tension may be applied to the wire line and the guide post removed from guide foot 28. The replacement guide post would be lowered from a production platform, floating rig or the like to subsea guide base 20. As soon as the guide post is removed from guide foot 28, handle 46 of latching mechanism 30 is rotated in the second direction or counterclockwise to the unlatched position shown in FIG. 7 by the diver or ROV. Latching mechanism 30 now is ready for automatically latching or stabbing the next guide post installed within the guide foot.

It will be understood various modifications may be made to the invention without departing from the spirit and scope of it. For example, the guide post retainer may be one or two piece. The beam of the guide post retainer, the guide post, the guide feet for receiving the guide posts, the guide base and the handle may be of various configurations. If the guide wire is connected to the top of each guide post, it would not be necessary to use a slotted guide feet or posts. Therefore, the limits of the invention should be determined from the appended claims.

What is claimed is:

1. Apparatus for guiding subsea well equipment, comprising:
- a frame for permanent attachment to a well installation and for receiving an upstanding retrievable guide post,
- said frame including a latching mechanism and a guide foot,
- said guide post including a shoulder,
- said latching mechanism including means for retaining said guide post,
- said foot including an upper slotted plate and a slotted base plate,
- each plate including a circular opening with said openings being vertically aligned with one another for receiving said guide post,
- said retaining means for engaging said shoulder of said guide post thereby latching said guide post to said guide foot.

2. The apparatus of claim 1 wherein said latching mechanism further includes a handle connected to said retaining means.

3. The apparatus of claim 2 wherein said retaining means is rotatably connected to said frame.

4. The apparatus of claim 1 wherein said retaining means includes a beam and a cylindrical portion having a threaded bore, said beam including a chamfered end for engaging said guide post.

5. The apparatus of claim 1 wherein said opening of said upper plate has a diameter greater than the diameter of said opening of said base plate.

6. The apparatus of claim 1 wherein said frame includes a plurality of outwardly extending legs and a plurality of guide posts, each of said legs for receiving one of said guide posts.

7. A method for retrieving a guide post from a subsea installation, comprising:
- providing a frame for attachment to a well installation,
- said frame including a guide post mounted in a guide foot and rotatable means for retaining said guide post,
- said guide post including a shoulder,
- said retaining means being in a latched position and engaging said shoulder of said guide post,
- rotating said retaining means in a first direction until disengaging said shoulder of said guide post,
- removing said guide post from said guide foot, and
- rotating said retaining means in a second direction opposite to said first direction.

8. The method of claim 7 including the additional step of positioning another guide post in said foot with said another guide post engaging said retaining means whereby said retaining means is rotated in said first direction until engaging a shoulder of said another guide post with said another guide post being latched within said guide foot by said retaining means.

9. The method of claim 8 including a handle being connected to said retaining means and rotating said handle in said first direction until said retaining means engages said shoulder of said another guide post.

10. Apparatus for guiding subsea well equipment, comprising:
- a frame for permanent attachment to a well installation and an upstanding retrievable guide post,
- said frame including a latching mechanism and a guide foot for receiving said guide post,
- said guide post including an upwardly facing annular shoulder,
- said latching mechanism including means for retaining said guide post,
- said retaining means for engaging said shoulder of said guide post thereby latching said guide post to said guide foot.

11. Apparatus for guiding subsea well equipment, comprising:

a frame for permanent attachment to a well installation and for receiving an upstanding retrievable guide post, said frame including a latching mechanism and a guide foot, said guide post including a shoulder, said latching mechanism including means for retaining said guide post, said retaining means including a beam and a cylindrical portion having a threaded bore, said cylindrical portion being rotatably connected to said frame, said retaining means for engaging said shoulder of said guide post thereby latching said guide post to said guide foot.

12. Apparatus for guiding subsea well equipment, comprising:

a frame for permanent attachment to a well installation, said frame including outwardly extending legs, each of said legs for receiving an upstanding retrievable guide post, each of said guide posts including an upwardly facing annular shoulder, each of said leg including a latching mechanism and a guide foot for receiving one of said guide posts, each said latching mechanism including rotatable means for retaining said one guide post and a handle connected to each said retaining means, each said retaining means being rotatably connected to said frame and including a beam for engaging said shoulder of said one guide post thereby latching said one guide post to one of said guide feet.

13. A method for retrieving a guide post from a subsea installation, comprising:

providing a frame for attachment to a well installation, said frame including outwardly extending legs, each of said legs including a guide foot and rotatable means for retaining an upstanding retrievable guide post, each said guide post including a shoulder, a handle connected to each said retaining means, each said retaining means being in a latched position and engaging said shoulder of one of said guide posts, rotating one of said retaining means in a first direction until disengaging said shoulder of said one guide post, removing said one guide post from said guide foot, rotating said retaining means in a second direction opposite to said first direction, and positioning another guide post in said foot with said another guide post engaging said one retaining means whereby said one retaining means is rotated in said first direction until engaging a shoulder of said another guide post with said another guide post being latched within said guide foot by said one retaining means.

* * * * *